US008241133B1

(12) United States Patent
Lewis et al.

(10) Patent No.: US 8,241,133 B1
(45) Date of Patent: Aug. 14, 2012

(54) AIRBORNE SPACE SIMULATOR WITH ZERO GRAVITY EFFECTS

(75) Inventors: James C. Lewis, Merritt Island, FL (US); Nick A. Mascia, Melbourne, FL (US)

(73) Assignee: Communications Concepts, Inc., Cape Canaveral, FL (US)

( * ) Notice: Subject to any disclaimer, the term of this patent is extended or adjusted under 35 U.S.C. 154(b) by 240 days.

(21) Appl. No.: 12/512,645

(22) Filed: Jul. 30, 2009

Related U.S. Application Data

(60) Provisional application No. 61/084,839, filed on Jul. 30, 2008.

(51) Int. Cl.
*A63G 21/10* (2006.01)

(52) U.S. Cl. ..... 472/59; 104/53; 104/63

(58) Field of Classification Search ..... 472/59; 104/53, 63
See application file for complete search history.

(56) References Cited

U.S. PATENT DOCUMENTS

| | | | | |
|---|---|---|---|---|
| 4,771,344 | A | 9/1988 | Fallacaro et al. | |
| 5,130,794 | A | 7/1992 | Ritchey | |
| 5,282,772 | A | 2/1994 | Ninomiya et al. | |
| 5,316,480 | A | 5/1994 | Ellsworth | |
| 5,354,202 | A | 10/1994 | Moncrief et al. | |
| 5,366,376 | A | 11/1994 | Copperman et al. | |
| 5,403,238 | A | 4/1995 | Baxter et al. | |
| 5,971,319 | A * | 10/1999 | Lichtenberg et al. | 244/1 R |
| 6,220,171 | B1 * | 4/2001 | Hettema et al. | 104/53 |
| 6,283,757 | B1 | 9/2001 | Meghnot et al. | |
| 6,743,019 | B2 | 6/2004 | Ransom et al. | |
| 7,084,774 | B2 * | 8/2006 | Martinez | 340/584 |
| 7,182,402 | B1 * | 2/2007 | Ahad | 297/362.13 |
| 7,281,761 | B2 * | 10/2007 | Brown et al. | 297/95 |
| 2003/0019136 | A1 * | 1/2003 | Whitman | 40/320 |
| 2006/0212998 | A1 * | 9/2006 | Gath | 2/423 |
| 2007/0153514 | A1 * | 7/2007 | Dowling et al. | 362/231 |
| 2008/0078875 | A1 | 4/2008 | Diamandis et al. | |

* cited by examiner

*Primary Examiner* — Michael Dennis
(74) *Attorney, Agent, or Firm* — Brian S. Steinberger; Phyllis K. Wood; Law Offices of Brian S. Steinberger, P.A.

(57) ABSTRACT

Systems, devices, apparatus and methods of using a simulator cabin module with an interior space which replicates a space ship, where the simulator module is mounted in a real aircraft, as a real airborne simulator. The aircraft lifts off to provide airborne maneuvers such as parabolic flight paths to cause G force and zero gravity effects to passengers in the cabin module. The cabin module includes rows of seats where passengers experience realistic sounds, lights, different temperatures, and physical effects (vibrations) of space ship liftoffs and space travel by having realistic simulation effects distributed over the seated passengers. Passengers can be seated in special reclinable seats with 5 point harnesses and pilot helmets with operable wireless communications and uniforms to add to the realistic simulation effects. Simulator modules can also be mounted in other moving vehicles, such as but not limited to submersibles, ships, and the like.

13 Claims, 6 Drawing Sheets

AIRBORNE SPACE SIMULATOR WITH ZERO GRAVITY EFFECTS

This invention claims the benefit of priority to U.S. Provisional Patent Application Ser. No. 6/084,839 filed. Jul. 30, 2009.

FIELD OF INVENTION

This invention relates to amusement rides and vehicle ride simulators, and more particularly, the present invention relates to systems, methods, apparatus and methods of providing a ride simulator which gives a passenger a realistic experience and impression of the actual sights, sounds, and motions occurring (or which have occurred) at a remote site through the use of a combination of stimuli. The remote site can be defined by a vehicle, conveyance, animal (a race horse, for example), human (a surfer or skier, for example), building (such as during an earthquake), or any other environment providing sights, sounds and movements which it is desired to experience in a simulated form, at a distance from the remote site. The combined stimuli are presented to the passenger through all of the senses of sight, sound, and touch. While actually moving in only a limited or confined space, the passenger experiences a simulated "ride" on a variety of vehicles, or "presence" at the remote site through the use of this invention. For example, a passenger may "ride" an Indianapolis 500 race car, a drag race car, a power boat, a land speed record car, an aircraft, a jet fighter, and any number of other interesting and potentially dangerous vehicles in which most people will never have an opportunity to ride. Also, a passenger on the reactive ride simulator may experience a ride or "presence" on a Kentucky Derby race horse, a surf board, on water or snow skis, on an Olympic bob sled, or within a building during an earthquake, for example.

This invention can provide these simulated vehicle "riding" sensations, or remote site "presence" sensations, to a passenger using a multi-media, or combined sensory menu which is either historical, near-real-time, or actually in real-time while the actual vehicle being simulated is in motion. For example, the passenger can experience a "ride" in a race car while sensory data (i.e., the sights, sounds, and G-forces from the motion of the car) are obtained from an actual racing car on a racetrack. In this way, the passenger can ride along with a favorite driver in the Indianapolis 500 mile race. For example, and experience the actual sensations of the racing, car in competition as well as the spontaneous give-and-take of heated, unpredictable competitive racing as the race is actually in progress.

BACKGROUND AND PRIOR ART

Aircraft flight simulators and automobile driving simulators have been in existence for many years. In their rudimentary form, these simulators provide a movie or video tape of the view through a vehicle windshield so that the "pilot" or "driver" in the simulator can respond to the events viewed as they are presented to the viewer.

Automobile driving simulators of this type have long been used for driver training. In the use of these driver training simulators, the trainee sits at a console or table equipped with a steering wheel, gas pedal, and brake pedal, which together simulate the controls of an automobile. The trainee views the movie on a screen or sees a video presentation on a television monitor. As the movie or video presentation takes place, the trainee is presented with a variety of driving situations, to which the trainee is to respond with appropriate inputs to the simulated automobile controls. These simulated controls are connected to an instructor's monitoring instrument so that students may be scored on their performance. The trainees who not make the appropriate control inputs may be identified and further instructed.

Understandably, this rudimentary driver training simulator does not have a high degree of realism. There is no unpredictability in this simulator. Once a student has experienced one training session, that same training movie or video will be familiar, and the student's driving responses will be conditioned by experience rather than being the spontaneous result of a proper response to an unexpected situation. For this reason, a variety of different movies or videos need to be created and provided to students for use with this type of simulator.

The rudimentary flight simulators operate similarly to driver training simulators. Some of these conventional simulators combine a sound track with the visual presentation to the trainee. For added realism, this sound track may be recorded in an actual vehicle in operation. More advanced flight and driving simulators add computer graphics generated in real-time, or near-real-time, combined with sound effects also generated to correlate with the visual presentation to enhance the spontaneity and realism of the simulation. These rudimentary systems are limited by the computational power required to generate video images and appropriate sounds in real-time. Some of these simulators allow an instructor to pre-set a situation for presentation to a trainee, or to introduce impromptu changes in the situation as presented even while the training experience is underway. However, these options also require substantial added computational power from the simulator system.

More advanced flight simulators add a motion platform on which the trainee or passenger is carried and moved in an enclosed cabin in order to experience the sights, sounds and simulated acceleration forces (herein, "G-forces") correlated with the apparent motions of the simulated aircraft on the ground or in flight. Such motion platforms move only a few inches or feet, and have a limited range of G-forces which may be provided to the passenger in the simulator. These G-forces are provided by a combination of horizontal and vertical accelerations, (resulting in limited horizontal and vertical motions of the cabin), combined with rotational accelerations of the cabin (resulting in angulation or tipping of the cabin through limited angles), so that a portion of the gravitational force can be added to the G-forces generated by some cabin motions. Between sensory movements of the passenger cabin by such a motion base (which sensory movements are intended to impart sensory inputs to the passenger), the cabin of such motion base simulators is smoothly moved at a sub-perceptual rate toward a centered position in anticipation of the next sensory movement. That is, the cabin of the simulator actually has only a limited range of motion so that between sensory accelerations the motion base has to creep back toward its centered position. In this way, as much as possible of the movement of the motion base is available for the next sensory movements of the base.

Vehicle ride simulators have recently been developed based on the flight simulator technology described above. For example, the STAR TOURS® attraction at Disneyland in Anaheim, Calif., provides passengers with the simulated experience of riding in an interplanetary space ship during a trip to distant planets. Along the way, passengers participate in an attack on a hostile space ship. The cabin used can only move a short distance on a motion base while the passengers are provided with a visual and audio presentation simulating the space ship ride. While this visual and audio presentation is under way, correlated G-forces are provided to the passengers by motions of the motion base carrying the passenger cabin.

However, at this time there has not been such an interplanetary passenger spaceship which could have been used to provide the visual, audio, or G-force experience provided to the passengers of this ride. That is, the motions of this passenger cabin, and the resulting sensory G-forces experienced by the passengers, are believed to be those selected by a technician to go along with the visual and audio presentation. These G-forces are not reactions of a motion base to the actual G-forces experienced at a vehicle or other conveyance. This presentation is similar to a cartoon affected with modern visual special effects. Moreover, the degree of realism imparted by such a simulator depends in large measure on the skill of the technicians in selecting the G-forces to be experienced by the passengers, and in correctly timing these G-forces to the visual and audio presentation. In other words, the technicians have to plan and time the motions of the motion base which provides these G-forces to the passengers of the ride so that the impression of movement from riding on the simulated vehicle is correlated with the visual and audio presentation.

Another conventional vehicle ride simulator is similar to the STAR TOURS® ride in that it relies on a passenger cabin carried on a motion base, and within which passengers sit to receive a visual and audio presentation. However, this ride simulator uses a visual presentation similar to the early flight simulators or driver training simulators, in that it is recorded by a camera looking forward through the windshield of an actual vehicle of the type being simulated. An audio presentation also recorded in the actual vehicle is used along with this visual presentation to the passengers in the simulator. Thus, this simulator has true correlation of the visual and audio presentation, and a good level of realism in this respect. Moreover, the visual and audio presentation used in this simulator is similar to that sometimes provided to television viewers who can receive a audio/visual signal fed from an on-the-car camera and microphone of a racing car. The home television viewer, of course, has no-sense of the G-forces experienced in the racing car. On the other hand, the passengers in the simulator see the view through the windshield and hear the sounds of an actual vehicle, such as a NASCAR® stock car on the track at Daytona Beach, Fla., for example, while also experiencing simulated G-forces.

However, with this ride simulator as with the STAR TOURS® ride, the G-forces experienced by passengers In the simulator, and their tuning in correlation with the visual and audio presentation, are simulated and depend on the skill of a technician. This ride is not, reactive, because it does not drive a motion base using G-force data actually collected at the vehicle or other remote site being simulated. Thus, the realism achieved by this conventional ride simulator is also highly dependent upon the skills of a technician.

Various patents have been proposed over the years. U.S. Pat. No. 4,771,344, to Fallacaro et al. relates to a system for enhancing an audio/visual presentation, such as for viewers of a boxing match, by adding a sensory perception simulating the striking of blows as these blows occur in the actual boxing match. In this way, the usual vicarious participation in the boxing match by spectators can be enhanced. The system may include a device simulating the receiving of such blows also. The participant in this simulation of participation in the boxing match wear "boxing gloves", which include a remotely controlled "knuckle rapper". This knuckle rapper strikes the wearer on the knuckles to simulate the landing of a blow with the participant's fist. By the actions of a technician, the knuckle rapping is synchronized with the actual blows landed in the boxing match, so that the impression of being in the boxing match is enhanced for the participants in the simulation. This system relies for its realism on the skills of the technician to synchronize the knuckle rapping with the actual blows given in the boxing match.

U.S. Pat. No. 5,130,794, to Ritchey discloses a panoramic camera and panoramic imaging system. Real-time imagery from a vehicle in motion can apparently be provided to a spectator, but the spectator does not receive simulated accelerations (G-forces) from the vehicle in motion.

U.S. Pat. No. 5,282,772 to Ninomiya et al. relates to a ride simulator for giving passengers a simulated ride down a river rapids. The ride simulator includes a theater upon which a visual presentation is projected, along with water splash, river sounds, and wind. The "boat" in which passengers ride is swayed and tilted by a mechanism (which is similar to a motion base mechanism) under the a water channel carrying the boat so that riders have the false experience of shooting down a river rapids. Acceleration forces from an actual boat on an actual river rapids is apparently not used in this simulation. This simulation would again appear to rely for its realism upon the skills of a technician to provide and time G-forces to the audio/visual presentation.

U.S. Pat. No. 5,316,480 to Ellsworth disclose a multimedia (sight, sound, and motion) ride simulator with a passenger cabin moved by actuators while a audio/visual presentation is made to the passengers. The ride includes a real-time video presentation of familiar surroundings during an initial and concluding parts of the ride so that passengers have the impression of leaving the local of the ride on a moving vehicle, and later of returning to this same spot. This ride simulator does not appear to use G-forces from an actual vehicle to drive the motion base of the ride.

U.S. Pat. Nos. 5,354,202 to Moncrief et al.; and 5,366,376 to Copperman et al., both appear to relate to driving simulators. The first of these patents appears to relate to an arcade game, with a stationary seat for the player. There is not motion base involved in this game, and no simulation of G-forces for the simulated vehicle. The latter of these two patents appears to disclose another stationary driving simulator, again with no simulation of the G-forces for the simulated vehicle. Conventional, arcade games or simulators are also known which are believed to be similar to that of the '202 Patent discussed immediately above, but which also include a "seat shaker" or some other moving mechanism for the seat in which the occupant sits. However, all of these devices would appear to be very much lacking in realism compared to the experience provided by the present invention.

Finally, U.S. Pat. No. 5,403,238 to Baxter et al. relates to an amusement ride in which passengers actually do ride on a vehicle, which vehicle includes mechanisms to enhance the impressions received by the passengers that the vehicle is out of control or is following a perilous course. There appears to be the use of audio/visual effects in conjunction with this vehicle. However, there is not use of G-forces from an actual vehicle in motion to control a motion base.

Thus, the need exists for solutions to the above problems with the prior art.

SUMMARY OF THE INVENTION

A primary objective of the present invention is to provide ride simulator systems, devices, apparatus and methods which gives passengers realistic experiences and impression of the actual sights, sounds, and motions occurring (or which have occurred) at a remote site through the use of a combination of stimuli.

A secondary objective of the present invention is to provide reactive ride simulator systems, devices, apparatus and methods in which the G-forces experienced by passengers in the ride on a motion base are derived from the actual G-forces of the "remote site" vehicle; conveyance, animal, earthquake, or other situation of dynamic motion experience) being simulated.

A third objective of the present invention is to provide reactive ride simulator systems, devices, apparatus and, methods in which; the G-forces experienced by passengers in the ride on a motion base are not interpretations of actual G-forces (which interpretations are provided by a technician, for example), but are based on the actual G-forces of the "remote site" being simulated.

A fourth objective of the present invention is to provide ride simulator systems, devices, apparatus and methods in which the services of technicians or other person to provide interpreted G-forces for the motion base are not needed.

A fifth objective of the present invention is to provide reactive ride simulator systems, devices, apparatus and methods in which the passenger while experiencing G-forces on a motion base which are derived from the actual G-forces of the remote site being simulated, is also presented with the sights and sounds of the remote sight while the dynamic motion experience which creates these G-forces is underway.

A sixth objective of the present invention is to provide a reactive ride simulator systems, devices, apparatus and methods in which the simulation can occur either in real-time or near-real-time while the actual remote site is in motion, or can be recorded for later enjoyment long after the actual event has passed into history.

A seventh objective of the present invention is to provide a reactive ride simulator systems, devices, apparatus and methods in which the simulation can occur either in real-time or near-real-time, where computer controls enhance the simulation effects on passengers where seat belts and seat cushions are both loosened and inflated and tightened and deflated to extend effects of Zero Gs, as well as increase effects of G forces during liftoffs, simulated rocket blasts, and the like.

Accordingly, the present invention in accord with one aspect thereof provides a reactive ride simulator for providing to a passenger in the ride simulator a sensory experience of riding on a movable remote site in motion while in fact the passenger moves only a short distance aboard the ride simulator, the reactive ride simulator comprising; components for collecting from the remote site in motion at least a portion of the G-forces actually experienced there; a motion base carrying the passenger and reacting to the means for collecting by responsively moving the passenger to replicate the G-forces; whereby, the ride simulator reacts to those G-forces actually experienced at the remote site in motion to replicate these O-forces for the passenger.

According to another aspect, the present invention provides a reactive ride simulation method of providing to a human passenger a sensory experience of being at a remote site in motion, such as a simulation of riding on a vehicle or conveyance which is or was in the past actually in operation or motion, while the passenger in fact moves only a short distance aboard a reactive ride simulator within a confined area, the method comprising steps of: collecting from the remote site in motion at least a portion of the G-forces actually experienced there; and providing a motion base carrying the passenger, and causing the motion base to react to the G-forces collected from the remote site by responsively moving the passenger to replicate the G-forces.

An advantage of the present invention results from its not depending on the skills of a motion base technician to program the motion base to prove simulated or replicated G-forces. That is, the present invention uses actual G-forces sensed and/or recorded on the actual remote site (i.e., on a vehicle, for example) while in motion. These actual G-forces are used to provide the command inputs to the motion base. In this way, the optimum of realism and spontaneity may be provided to a passenger on the ride. The sights, sounds, and G-forces (within the limits of the motion base) of the actual remote site being simulated are provided to the passengers on the ride. When the reactive ride simulator is operated in real-time or near-real-time, the ride has the same spontaneity and lack of predictability as does real life. However, should the remote site be a vehicle which crashes, for example, the passengers on the ride are not exposed to the violent G-forces of the crash because the motion base is not capable of generating that kind of force. On the other hand, the present invention when operating with recorded visual, audio, and G-force data for a vehicle event in the past, such as for the winning, car of the Indianapolis 500 mile race, allows passengers on the simulator to "ride" along in the winning race car.

The invention allows for a simulator module that fits within a moving vehicle, such as but not limited to an aircraft, boat, and the like. The simulator module would have a built in simulation environment that can produce realistic visual effects, sound effects, motion effects, physical, effects (vibrations, and the like), light effects, smells (odors), of an actual experience such as space ship lift off and travel. The simulator module can fit within an actual moving vehicle such as an airplane that can ad real zero gravity effects to the occupants of simulator module.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
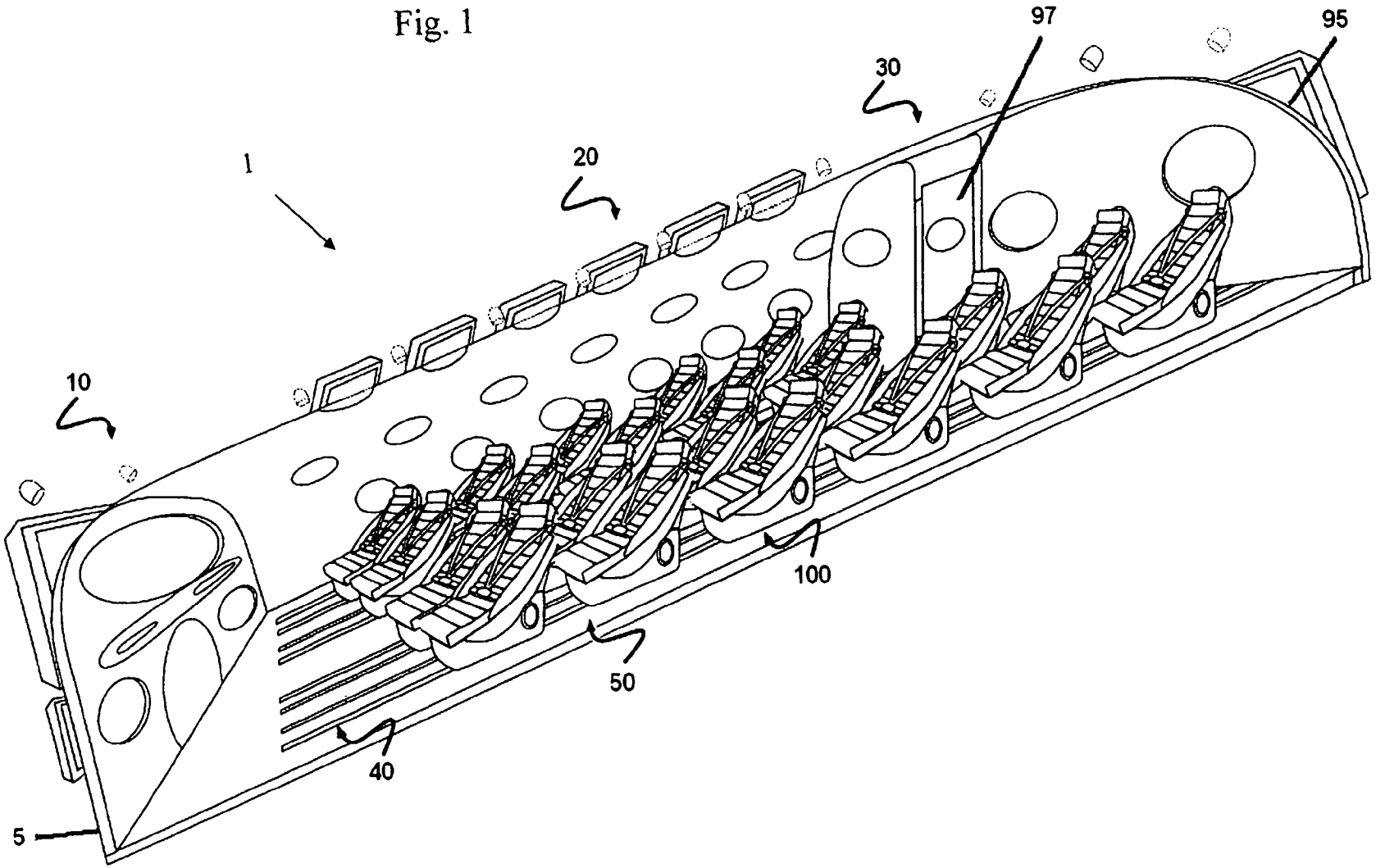
FIG. 1 is a cutaway view of a reactive ride simulator vehicle.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components will now be described.

1. Reactive ride simulator module
5. Front of vehicle
10. Programmable lighting
20. Port & starboard monitors
30. AV station
40. SIM AV/Interlock tracks
45. wide aisle space
50. Glow light under each seat to simulate re-entry heat

Figure 2:
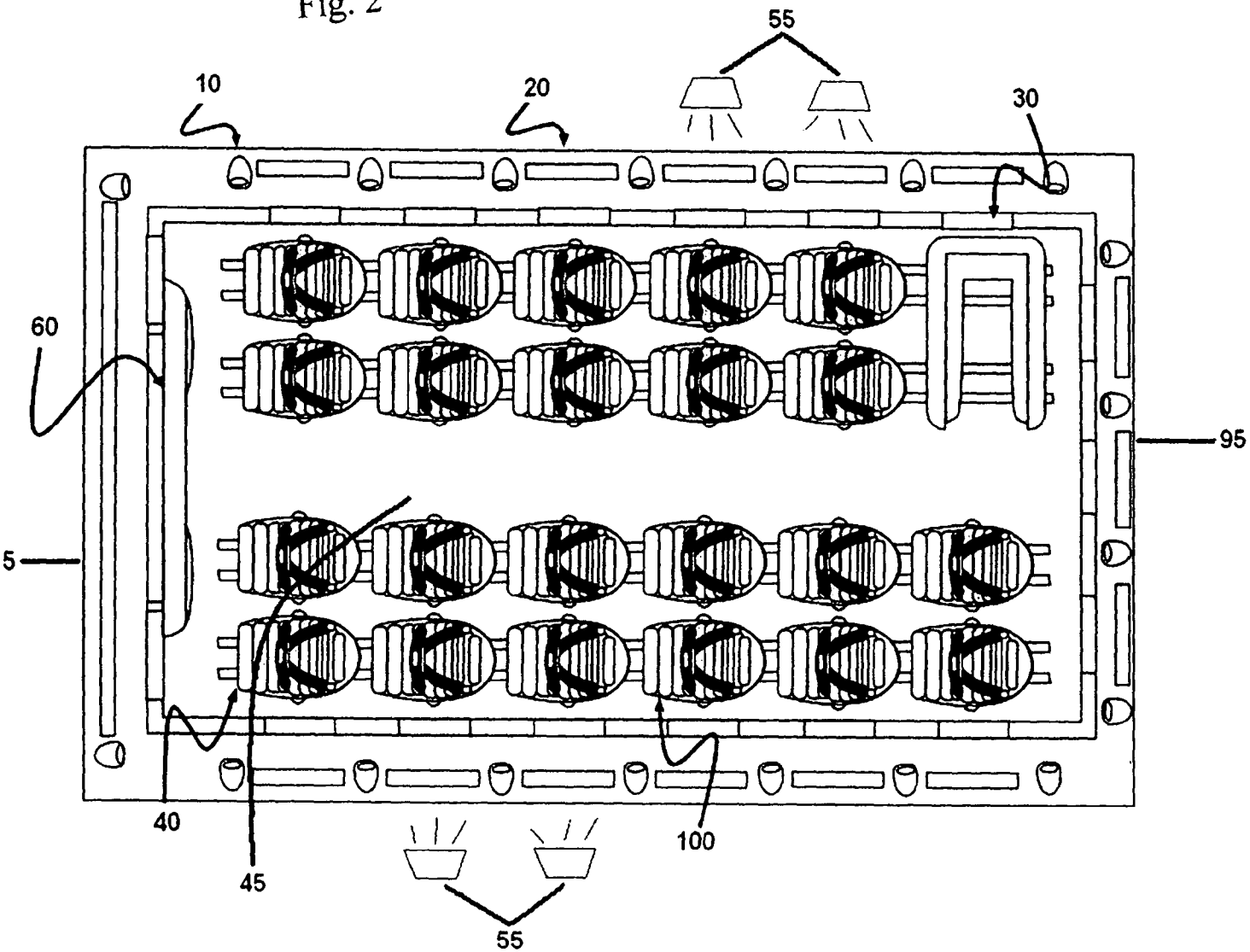
FIG. 2 is a top view of the reactive ride simulator vehicle of FIG. 1.
Figure 3:
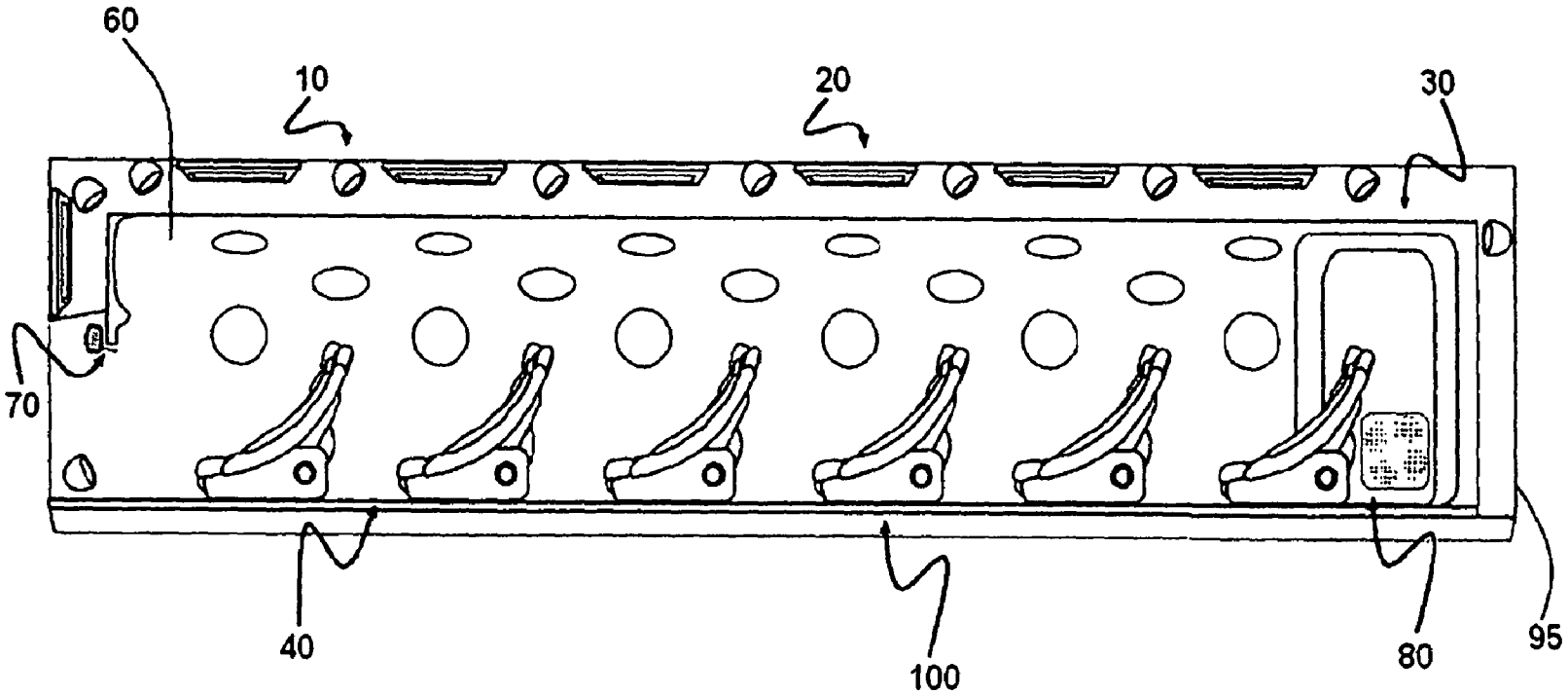
FIG. 3 is a side view of the ride simulator of FIG. 1.
Figure 4:
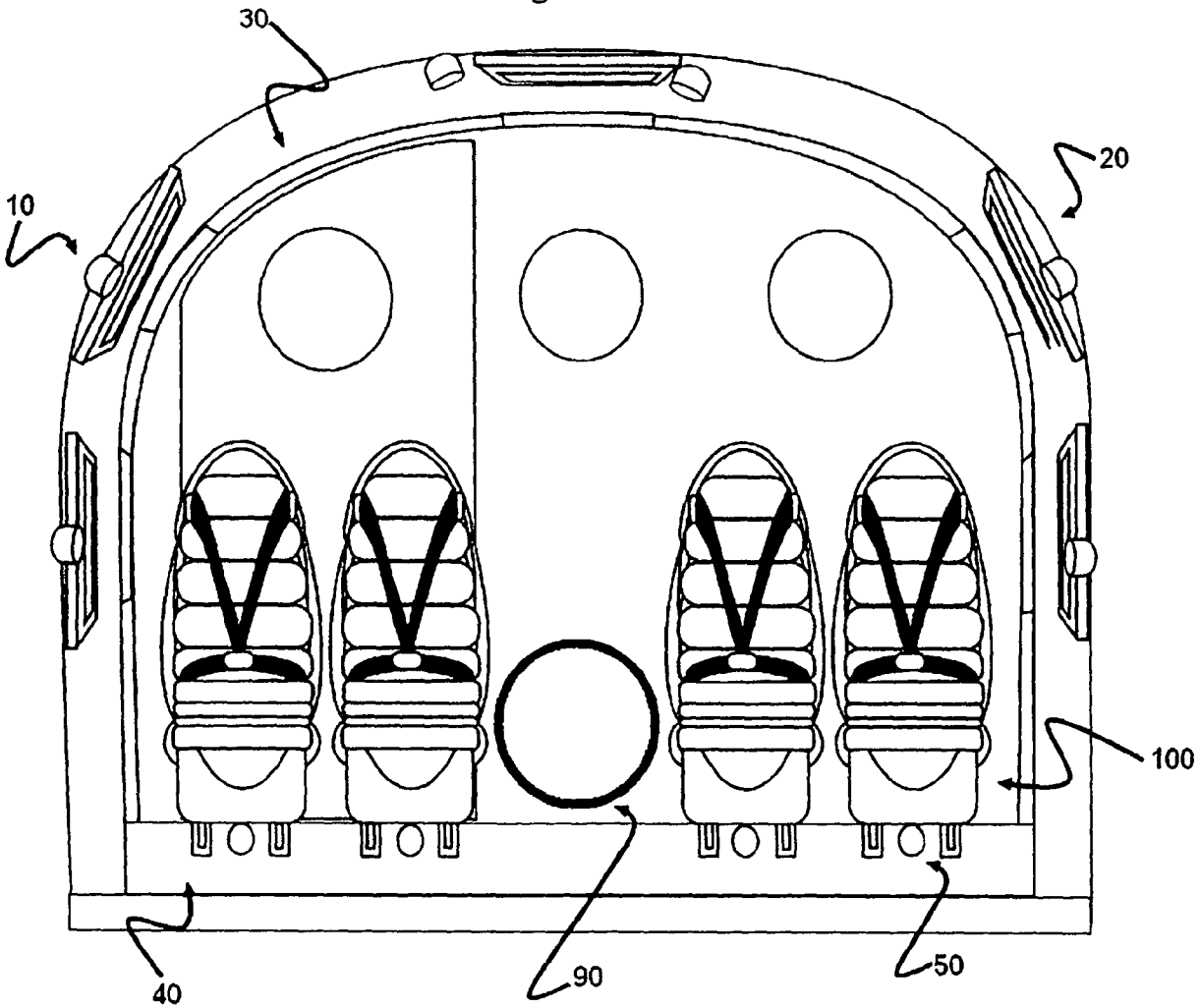
FIG. 4 is a front end view from behind the Avionics display of the ride simulator of FIG. 1.

55. Projector lights
60. Avionics/Avionics Display
70. Aroma Atomizer
80. Cabin air re-cycle fan with charcoal filter
90. Subwoofer (sound/vibration transducers) for blast and re-entry rumble
95. Rear of vehicle
97. Rear cabin door
100. Simulator chair(s)
110. Seat portion of chair with air bladders
120. lower back portion of chair with air bladders
130. upper back and head rest portion of chair with air bladders
140. five (5) point harness
150. reclinable back
160. base of chair
200. helmet
210. antenna or IR receiver
220. battery compartment to power headset
230. cabin air intake vents
240. Built-in wireless headset
250. rotatable visor
260. molded plastic helmet body FIG. 1 is a cutaway view of a reactive ride simulator vehicle 1. FIG. 2 is a top view of the reactive ride simulator vehicle 1 of FIG. 1. FIG. 3 is a side view of the ride simulator 1 of FIG. 1. FIG. 4 is a front end view from behind the Avionics display 60 of the ride simulator 1 of FIG. 1.

Referring to FIGS. 1-4, a preferred embodiment of the invention can use a closed cabin module 1 that can be mounted on a platform inside of flyable aircraft such as a Boeing 727. The cabin module 1 can include multiple rows of reclinable seats 100 that are individually mounted on SIM (simulator) AV/interlock tracks 40 that would be visible to the passengers. Underneath each of the rows can be a pair of interlock tracks 40 that allow the seats 100 to be located in selected positions relative to one another. Tracks 40 can be FAA approved standard aircraft mount tracks or rails currently used in most commercial aircraft. The base structure of the seat 100 can include a standard integral caliper-type configuration for slidable engagement about the head portion of a rail structure. A spring mounted plunger and associated actuating means, such as an eccentric, can be carried by each seat 100 and upon actuation of the eccentric, the plunger will extend into a rail cutout or detent for securing the caliper engagement and thus locking the seat to the rail. Upon further actuation of the eccentric the plunger can contract and unlock the seat.

Some seats 100 can be spaced further apart from one another for creating larger amounts of leg room for larger passengers, and some seats 100 can be spaced closer to seats 100 for smaller passengers such as for children. In a preferred embodiment four sets of double tracks 40 can be located in the floor so that up to four seats 100 can be positioned side by side to one another, with a larger wide aisle space 45 running down the middle of the floor, between the front 5 and rear 95 of the cabin module. The reclinable seats 100 are described in greater detail, in reference to FIG. 5.

In order to further recreate the realistic effect of space travel, the inside of the cabin module 1 can be designed to replicate the inside of a space ship, and would include port and starboard monitors 20 on both the left and right sides of the interior walls. The monitors can be LCD (liquid crystal displays), plasma displays, and flat screen type displays and the like. The port monitors 20 can display realistic video through port shaped windows that would simulate activity on the left side of the module facing forward. Likewise the starboard monitors 20 can display realistic video through port shaped windows that would simulate activity on the right side of the module facing forward. The video can show images of ground based launch sites, as well as sky and outer space images that run during the simulation ride itself. Passengers can be provided with Avionic displays that will initially provide real flight data and then when appropriate provide simulated flight data. The data can include similar data that passenger receive in modern commercial passenger aircraft such as altitude, speed and direction, plus additional data such gravitation force.

The AV station can be a modular equipment rack or mounting system that will house the various required AV components such, as computers and amplifiers.

Also around the tops and sides of the cabin module 1 can be programmable lighting 10 that can display realistic lighting and sign effects to the passengers, such as but not limited to green, yellow and red lights, other colors and combinations thereof, as well as signs for ordering passengers to buckle their seats, prepare, for lift off, and the like. The lights 10 can be programmed to timely operate sequentially and/or illuminate at different intensities. The lights 100 can be LED (light emitting diodes), and the like.

Below the seats 100 can be additional glow and heat lights 50 such as different glowing shades of colors, such as yellow, red, orange, and the like, which can glow at different colors and intensities to simulate re-entry heat, and the like. These lights 50 and others can also give off real heat effects to better create the realistic simulation. The glow and heat lights 50 can be programmed to emit heated temperatures up to approximately 110 degrees F. during lift off and landing simulations, and the like. Under Furniture Mood Lighting such as LIT energy efficient light strips under the seats will make the floor underneath the each seat brilliantly glow red simulating the heating of the floor of the plane during re-entry. Heater/blowers such as Power Hunt Blows PNP-200A will be used to blow hot air at passengers to further create the illusion of heat on re-entry.

Other novel lighting can also be used with the invention. Small projector type lights 55 that create a simulated pattern of fixed light, can be mounted to interior walls adjacent to the port hole windows (monitors). The projector lights can shine beams of light into the cabin of the simulator module to represent the motion of the vehicle against an exterior light source such as the sun, stars, shadows, clouds, and the like. To accomplish this effect a compact projector light with a moving mirror, such as a junior Scan Light, and the like, can be used. This light can be computer controlled to allow lighting effects to occur at the correct times to further enhance the simulated feeling of flight. By the use of a moving mirror that both pans and tilts and the light will generating move light patterns in many dichroic colors and white with multicolor effects and a high speed shuttering. As an additional, highlight the Junior Scan includes an approximately 4.5 mw powerful laser diode that also may be positioned by a mirror.

The impinging light beams can move across the insides of the cabin module to further simulate the effect of traveling through these conditions. The light projectors 55 can simulate other sources of light such as artificial light coming into the port windows from other vehicle headlamps, and/or weapons, and/or other sources of exterior lights.

Sound and vibration effects 90 can be provided by speakers positioned about the cabin compartment, where the passengers can be given directions and orders such as to buckle up, remain seated, etc. during the Simulation ride. Sound effects can be used from stock sound effects libraries, Such as but not limited to Iris Sound FX, Vance Audiotronics or other similar digital SEX library typically used for movies and TV (television) shows. The sound effects can be selected to enhance or compliment both the real and simulated events in the flight, such as blast-off, re-entry, and so forth. Using audio sequencing software, the sound effects can be placed on a time line in a computer or PC (personal computer) that matches the time line of the real flight and simulated Mission.

During the simulated mission, the time line will be played out in time with the flight or mission and the correct audio sequence will play in the required time frame. The computer will be connected to either an internal or external 5.1 Surround Sound Module, such as Creative Labs Sound Blaster X-Fi Surround 5.1 USB Sound Card or other similar card. The five channel sound from this module will be connected to a series of audio power amplifiers and to wireless transmitter. The amplifiers will be connected to speakers and sub woofers in the crew or simulator module and the wireless transmitter will transmit sounds to the passenger helmets.

Other sound and vibration devices 90 such as but not limited to subwoofers and the like, can be incorporated into the cabin for causing low frequency sounds and vibrations to the seated passengers. A subwoofer can be incorporated to direct sounds and vibrations down a middle aisle between the rows of the seats to replicate blast off noises and re-entry rumble noises.

Odor sources 70 can be used distribute odors, such as but not limited to burnt smells, burning fuel, and the like, can be introduced into the cabin about seated passengers. A system such as Scent Air-Scent Wave dry air fragrance dispenser, can be used which releases smells without the use of sprays, aerosols, or heated oils, can be used. The scent/odor system can be computer controllable and allows for varying the duration and intensity of smells to simulate any environmental condition.

Different sensor effects such as sounds, lights and/or smells, temperature modifiers, vibration sources, and the like, can be combined in different arrangements to further cause a realistic effect to the passengers. Still furthermore, the cabin module can incorporate other simulator devices, such as but not limited to XYZ moveable platforms to further add to the simulation effects, while the cabin module is mounted in the actual moving vehicle body. Such XYZ simulator platforms, can include but are not limited to those described in U.S. Pat. No. 6,283,757 to Meghnot, to which is incorporated by reference.

The passengers can enter through a rear door 97 into the cabin to take their seats 100 and the passengers can be outfitted in gear such as but not limited to realistic helmets, and the like, as well as wear space uniforms, such as jumpsuits, and the like. An example of a helmet will be described in greater detail in reference to FIG. 6.

In the front of the cabin can be an avionics wall separating the passenger compartment area from the forward pilot station.

Figure 5:
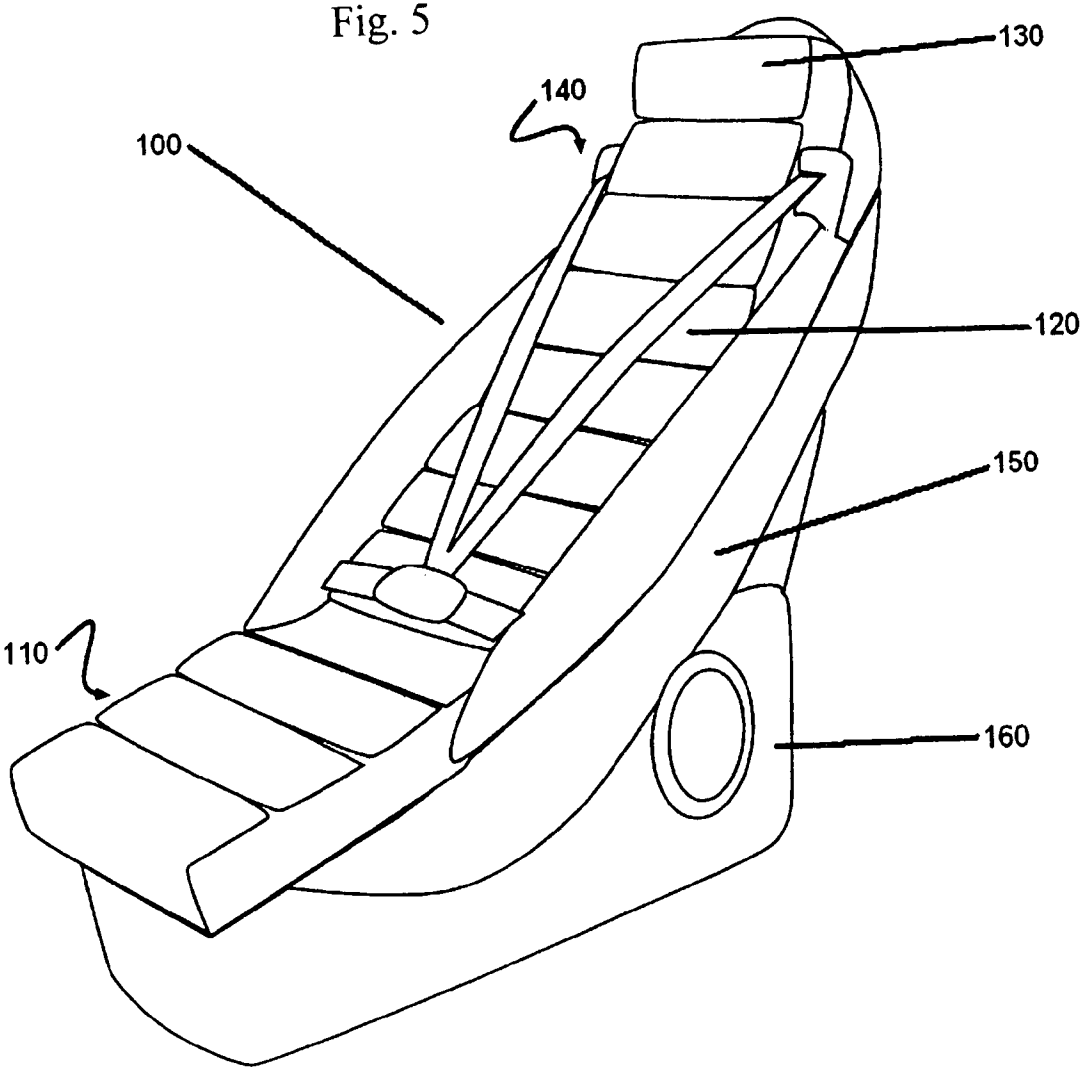
FIG. 5 is an enlarged perspective view of seat for use in the simulator vehicle of FIG. 1.

FIG. 5 is an enlarged perspective view of seat 100 for use in the simulator vehicle of FIG. 1. The simulator chairs 100 can be futuristic in appearance, and have a lower elongated seat 110 and leg support area 110, with lower back 120 an upward backing section 130 with head portion which substantially supports the rear of the passenger's head. Across the front of the seats can be five point harness seat belt 140 having a single clip which holds both ends of waist belt in place while also holding the bottom of a V shaped upper belt 140.

The seats 100 can have temperature controls where the passenger can experience warmth and heat during lift off to replicate the heat of a blast off. Later on the passenger can experience cold sensations to simulate outer space cold conditions to further add to the realistic simulation effects.

Each seat 100 can further include inflatable and deflatable air bladders across either or both the lower seat portion 110, and/or the lower back-portion 120 and the upward seat back portion 130. The air bladders can be inflated and deflated at different times to further add to the realistic simulation effects. The back portions 120, 130 can be inflated and deflated at different times from the seat portions 110. This type of seat system 100 is known as "G" seats. "G" seats are designed for providing kinesthetic (sensation of motion) cues to a pilot or passenger of a simulated aircraft or spacecraft.

The seat 100 is designed specifically to stimulate elements of the haptic sensory system and is capable of independently producing desired skeletal attitude shifts, area of flesh contact changes and flesh pressure gradient variations and coordinating same to simulate acceleration effects. The seat 100 can contain two mosaics of air cells forming a seat cushion and a back cushion, respectively. The air cells can include tension spring loaded bellows having rigid top plates. The top plates of the cells in each mosaic form a body supporting surface of the corresponding cushion. The cells can be individually driven under computer control to vary the elevation, attitude and shape of these body supporting surfaces. In addition, clam-shell shaped air cells are positioned on either side of the seat cushion to provide thigh pressure and area of contact variations and a lap belt is driven to provide ventral area pressure variation.

Computer controls enhance and extend the effects of both Zero Gs, and effects of increasing G forces during the simulation. By fully inflating the seat 100 bladders and loosening the seat belt 140 the person sitting in the seat senses that, they are lighter or floating in zero Gs. A sensor on the belts 140 notifies the operator that the passenger is locked in. A system computer will loosen the belt and inflate or deflate the bladders. So while the aircraft approaching Zero Gs, the computer can fully inflate the seat bladders and loosen (relax) the seat belts 140 up to approximately 1 to approximately 3 inches to be separated from the passenger. The approximately 1 to approximately 3 inches would be in both the lap, and shoulder harness belts.

The invention is heightening and extending the effects (sensation) of Zero Gs. For example, if the aircraft is experiencing Zero Gs for approximately 30 seconds to approximately two minutes, the combination of bladder inflation and belt loosen effects can extend this run for an extra approximately 15 to approximately 30 seconds at both the beginning, and end of the Zero G run. This belt loosen and bladder inflation combination substantially increases the time of sensation (effect) of weightlessness on the passengers.

The computer can also increase G force effects on the seated passengers. Conversely by deflating; the seat 100 bladders and tightening the belts 140, the passengers feel as if they are being pulled down into their seats 100, creating the senses of increasing the G forces on the passengers. For example, during lift off simulation, the bladders can be fully deflated and the seat belts fully tightened to enhance the take off effect sensations on the passengers. Tightening the belts would include having the belts press against the shoulder and laps of the passengers. During this combination (of belt tightening and bladder deflations), the passengers will feel as if they are being pulled back into their seats 100 by increased gravity. Similarly, the computer can automate the bladder deflating and belt tightening combination during lift off, and also when the aircraft is simulating an extra rocket blastoff at different stages as the aircraft is taking off.

A pivotable back 150 for the lower and upper seat and back portions 110, 120, 130 allow for the seats 100 to be able to pivot so that the head or footer portion of the seats 100 rise up and lower down, and move from upright to reclinable positions. The pivotable back moves relative to the base 160 which is attached to the floor interlocks 40.

Figure 6:
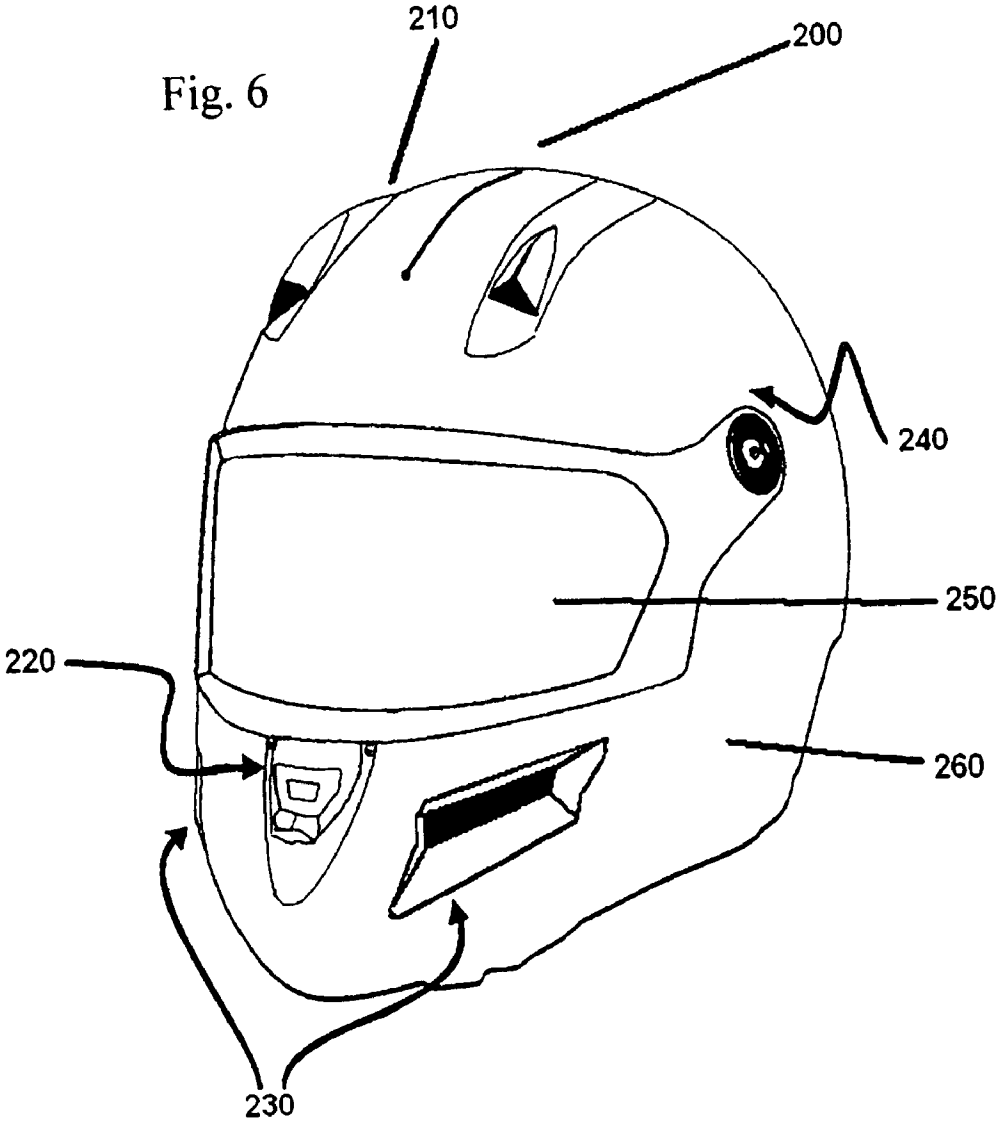
FIG. 6 is an enlarged perspective view of a helmet used in the simulator vehicle of FIG. 1.

FIG. 6 is an enlarged perspective view of a helmet 200 used in the simulator vehicle module 1 of FIG. 1. The helmet 2—can be realistic pilot helmet being a full face helmet with vent openings 230 about the mouth portion, and a battery compartment 220 to provide power to a headset that is built into the helmet. The built-in headset 240 with internal speakers can allow for wireless communications between the passenger wearing the helmet and a remote site. The top of the helmet can have an antenna and/or IR (infrared) receiver 210 that allows for additional communication. The helmet 200 can also include lights that can further be activated to add to the realistic simulation effects. The helmet 200 can be formed from body 260 molded plastic, fiberglass and the like, and include a rotatable visor 250. A helmet such as Schuberth F1 type helmet, and the like, can be used. This helmet allows built in communications equipment, for air flow so smells can be induced, and the latest model Schuberth helmet even offers a built in heads-up display that could be feed data about the flight and simulated flight.

The aircraft in which the cabin module is mounted, can take off and provide additional realistic effects such as weightless zero gravity effects, and different gravity levels for the passengers. U.S. Pat. Nos. 5,971,319 to Lichtenberg et al.; and 6,743,019 to Ransom et al., and U.S. Patent Publication 2008/0078875 to Diamandis et al., which are all incorporated by reference, describe techniques of using aircraft to cause acceleration, deceleration, weightless gravity effects, and different gravity effects when flying the aircraft in different airborne maneuvers such as during parabolic flight runs. However, none of these references as been able to incorporate a realistic cabin module into the aircraft during operation.

The subject invention can incorporate the ZERO G® experience currently being provided by Space Adventures Ltd. which flies aircraft where passengers in open cargo type bays are released into an open cargo hold area during real world flights. The ZERO-G ® Experience consists of a brief training session for passengers followed by a flight aboard a specially outfitted aircraft, during which parabolic maneuvers are performed; The modified aircraft is able to fly various parabolic flight maneuvers of controlled ascents and descents of create temporary weightlessness or reduced gravity.

The total flight duration is approximately 90 minutes, during which passengers can experience different levels of gravity, such as ⅓-gravity, ⅙-gravity, and zero gravity, and can cost upwards of several thousand dollars per ride.

The aircraft in the ZERO-G® Experience has an interior divided into two zones. A rear area which provides seating and FAA-required provisions (i.e. emergency oxygen, escape path lighting, floatation device, etc.) for up to 35 cabin passengers and crew. The second area is the forward section where passengers can float and fly during the periods of weightlessness. The floor and walls of the forward section can be covered with a special FAA-approved 1.5-inch energy absorbing Ensolite padding. However, again, the ZERO G® flights do not have any types of realistic cabin modules, seating, helmets, and there are no realistic sensory effects (sounds, lights, smells, motion, effects (vibrations)) which are part of the subject invention.

The combination of the simulator cabin module with a real aircraft is to provide to the space tourist passenger an extra-sensory, immersive experience (sight, touch, sound, motion, odors) replicating a zero gravity sub-orbital space mission experience whilst airborne in a modified plane via a uniquely designed simulator module.

With the invention a realistic experience takes place in a self-contained cabin equipped with all necessary ride simulator components consisting of Pre-programmed Video Screens, stereo speakers, vibration platform, remote control moving seats with inflate/deflate air bladders, special lighting effects, pipettes to distribute odors, subwoofer for low frequency sound and vibration effects.

The palletized, portable cabin Module can be placed into a cargo cabin of a real aircraft such as a Boeing 727 or other aircraft and secured for takeoff. The space traveling passenger, who is outfitted in an replica of an astronaut helmet and suit, is shielded from the actual outside view and instead is 'immersed' into the space ship environment viewing flat LCD 'window' screen scenes initially showing the actual "live" views you would normally see out the airplanes window with images seamlessly changing to simulated images of an airborne rocket firing and scenes of outer space all while simultaneously experiencing simulated effects of a flight and space mission from airplane like take off to a rocket blast to outer space, to weightlessness, to re-entry, and to landings.

By experiencing an ultra-realistic and airborne re-enactment of a rocket blast via various programmed vibrations, visuals, odors, sounds, lighting, effects, motion effects (possible XYX platforms) and then weightlessness (zero gravity parabolic flights), the space passenger is given a surreal and thrilling experience that only astronauts receive.

There are many benefits with the invention over existing Space simulators and Space Travel Rocket Vehicle Adventures.

A. Space travel simulators are presently grounded thus limiting and minimizing an actual in-flight experience. Also, minimal creative use of lighting and odor effects have been used:they are mainly audio-visual and motion driven.

B. For the planned Space Travel Vehicles/Rockets (None have actually flown yet and maiden flights are scheduled for 2010), the following benefits are achieved and realized by the subject invention:

a. Drastically lower cost: as low as approximately $2,000 to approximately $10,000 (to be determined by field marketing feasibility and actual build cost of the invention cabin module) compared to approximately $100,000 (Rocketplane), $200,000 (Virgin Galactic), $20 Million (Souyez)-$100 Million (Moon trip)

b. While all planned Space Travel vehicles to be used for space tourism have not yet flown before, a definite question of flight safety, has not yet been evaluated or determined lending an element of risk and failure to these future sub-orbital and orbital missions. Flights on a Boeing 727 and other vastly proven cargo aircraft insures for SVfx space tourists an enjoyable, stress-free (from anon-recoverable, unpredictable failure and abandonment in space) inspiring experience.

C. The invention experience immediately heightens interest and, focuses purpose on Space travel to achieve benefits for all mankind (Intl. Space Station lab experiments)>Moon and Mars Missions.

D. As an educational and learning experience for teachers and students alike (cost to be covered by sponsors), inspirational and directed studies in the Space Sciences can be a consequence of the subject invention journey over and above the excitement and thrill of the ride itself.

E. Modular design of the subject invention allows for alternative embodiments: EXAMPLE: a mobile land ('Ride into the Amazon') and beneath the Sea (Journey to the Titanic and Giant Squid') experience simply by interchanging the video, sound, lighting, vibratory and Olfactory, programming.

F. Zero gravity flights are available @$4K but are devoid of any of the above mentioned SVfx effects.

Although the preferred embodiment describes the invention as using a cabin module on a platform within a real aircraft, such as a Boeing 707, the invention can use the cabin module in other vehicles, such as but not limited to submersibles, such as submarines, ships, a power boat, hydrofoil boats, and other craft which allow for changes in pitch and yaw effects, and the like.

Also, the cabin module interior can simulate other craft such as an Apollo Space Capsule, flying saucer, a jet fighter, and the like, as well as the inside of a Indianapolis 500 race car, a drag race car, a land speed record car, a train, and the like.

Still furthermore, the invention can use other crafts and vehicles. For example, the existing NASA® space shuttles which are being discontinued can be reduced to their shell forms, and have passenger seating and simulator equipment mounted inside. The inside of the existing shuttles can be modified to include a cabin module with seating and all the other simulation equipment previously described.

The retro-fitted shuttles can then be flown on supporting aircraft such as 747s and the like, where the supporting aircraft with the modified shuttle goes through maneuvers such as the parabolic flights, and the like, to simulate weightless and modified G environments.

Passengers sitting inside the shells of the original shuttles can experience an ultra-realistic and airborne re-enactment of a rocket blast via various programmed vibrations, visuals, odors, sounds, lighting effects, motion effects (possible XYZ platforms) in the cabin module that is coupled with actual weightlessness effects based on the parabolic flights caused by the flying maneuvers of the aircraft that that modified shuttle is attached to. The space passengers in the retro-fitted shuttle can be given a surreal and thrilling experience that only astronauts receive. The passengers in the retro-fitted shuttles can experience a realistic simulation ride incredibly close to the real thing.

Other crafts and vehicles, can also be retro-fitted such as retired military jets, old space capsules, missiles, submarines, ships, and the like, to incorporate passenger seating and simulator equipment, where the retrofitted shells of previous real crafts then are taken on actual maneuvers to create weightless and different G force levels. The retrofitted crafts can be attached outside of or into real flying aircrafts.

Additionally, the invention can be used to allow a passenger to have a realistic simulated effect of being on a Kentucky Derby race horse, a surf board, on water or snow skis, on an Olympic bob sled, or within a building during an earthquake, and the like.

While the invention has been described, disclosed, illustrated and shown in various terms of certain embodiments or modifications which it has presumed in, practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An airborne space simulator, comprising:

an aircraft having a cargo hold area, the aircraft being capable of taking off and landing; and only one single portable cabin module independent of the aircraft cargo hold area for being fixedly mounted inside the cargo hold area spaced a distance away from the side walls of the aircraft cargo hold area of the aircraft, the only one single portable cabin module having a closed interior space simulating an interior of a spacecraft designed for space flight, with seats inside and attached to the only one single portable cabin module, and side window video screens and sound emitters for displaying recorded audio/video positioned between the aircraft side walls and an exterior of the only one single portable cabin module to simulate sensory effects of space flight travel liftoff, wherein the only one single portable cabin module is stationary within the aircraft cargo hold area when the aircraft physically takes off from ground level to simulate motion effects of space flight travel liftoff to passengers in the seats within the only one single portable cabin module; and helmets for each of the seated passengers, the helmets having cabin air intake vents on a front portion of the helmets, and built in wire-less headsets for allowing each of the seated passengers to hear remote verbal directions and commands.

2. The airborne space simulator of claim 1, wherein the aircraft includes:

a Boeing 727.

3. The airborne space simulator of claim 1, wherein the seats include:

rows of seats replicating a cabin on an aircraft, the rows of seats being mounted to parallel interlock tracks running lengthwise through the cabin module.

4. The airborne space simulator of claim 1, wherein the seats include:

inflatable and deflatable air bladders for raising and lowering portions of each of the seats between fully inflated and deflated positions.

5. The airborne space simulator of claim 1, wherein the seats include:

temperature controls for increasing temperatures and decreasing temperatures to the seated passengers.

6. The airborne space simulator of claim 1, wherein the seats include:

reclining portions that are remotely controlled.

7. The airborne space simulator of claim 4, wherein the seats include:

five point harnesses for each of the seated passengers, the harnesses allow for both supporting the passengers in both loose and tight belt configurations, wherein a combination of both a loosened belt configuration along with a fully inflated positions of the bladders allow the passengers to be in a floating and weightless condition, and where a combination of the deflated bladders and the tightened belt configuration allow the passengers to be in a pulled down condition when the passengers are in a simulation for taking off.

8. The airborne space simulator of claim 1, wherein the cabin module includes:

programmable lighting effects that turn on and off lighting colors to the seated passengers.

9. The airborne space simulator of claim 1, wherein the cabin module includes:

glow lights under the seated passengers to simulate reentry heat.

10. The airborne space simulator of claim 1, wherein the sound emitters include:

subwoofers for causing low frequency sounds and vibrations to the seated passengers.

11. The airborne space simulator of claim 1, further comprising:

odor distributors to distribute odors into the cabin about the seated passengers.

12. The airborne space simulator of claim 1, wherein the aircraft includes:

maneuvers to cause G-force effects to the seated passengers in the cabin module.

13. The airborne space simulator of claim 12, wherein the maneuvers include:

parabolic flight paths that cause weightless effects to the seated passengers.

* * * * *